United States Patent [19]

Hurt et al.

[11] Patent Number: 4,941,532

[45] Date of Patent: Jul. 17, 1990

[54] ANCHOR DEVICE

[75] Inventors: Floyd R. Hurt; Lawrence W. Berger, both of Belfield, N. Dak.

[73] Assignee: Elder Oil Tools, Yorktown, Tex.

[21] Appl. No.: 331,290

[22] Filed: Mar. 31, 1989

[51] Int. Cl.[5] ..... E21B 23/00

[52] U.S. Cl. ..... 166/216; 166/217

[58] Field of Search ..... 166/382, 206, 213, 216, 166/217

[56] References Cited

U.S. PATENT DOCUMENTS

| | | | |
|---|---|---|---|
| 1,074,427 | 9/1913 | Frederickson | 166/216 |
| 2,111,793 | 3/1938 | Lee et al. | 166/216 X |
| 4,496,000 | 1/1985 | Weeks | 166/382 |
| 4,678,209 | 7/1987 | Guice | 175/423 X |
| 4,715,456 | 12/1987 | Poe, Jr. et al. | 175/423 |

*Primary Examiner*—William P. Neuder

[57] ABSTRACT

An oil well tubing anchor for anchoring in large diameter casing after passing through small diameter casing where the anchor employs wall engaging members on the end of pivotally supported arm members and an expander for sequentially moving the arm members radially by use of cooperating, differently inclined surfaces. The tool is moved between collapsible and expandable position by rotations.

11 Claims, 3 Drawing Sheets

ANCHOR DEVICE

FIELD OF THE INVENTION

This invention relates to anchor devices for well tools and/or well strings in well bores traversing earth formations, and more particularly, to mechanical slip anchor devices which are collapsible to a diametrical size adaptable for passage through a restricted bore diameter in a well bore and which are subsequently expandable in a larger diameter bore to an anchoring condition.

BACKGROUND OF THE INVENTION

Anchor devices for well tools and well strings are commonly used to releasably attach well tools and equipment to a well casing or well pipe where the well pipe is a tubular metal member and traverses earth formations. An anchor device can be utilized with a variety of well tool devices, for example with a rod pump, or can be incorporated in a tool such as a bridge plug or packer. Irrespective of the application, the anchor device must be passed in a retracted condition through the bore of the casing or pipe to a location where setting of the anchor is intended. Setting of the anchor device involves extending gripping members radially outward from the device into gripping contact with the bore of the casing or the pipe. Once extended, in releasable anchor devices, the anchor device can be subsequently released and moved to a retracted condition for retrieval. Alternatively, in some releasable devices, if a malfunction prevents retraction from an extended condition, the anchor device can be disabled by actuating a shear means so that the gripping members retract and the anchor device can be retrieved.

In mechanical anchoring devices utilizing slips, the slips are elongated members disposed circumferentially around an annular bowl member an "expander") which has an inclined or wedging surface. The inclined surface on an expander are movable relative to inclined surfaces on the slips and are cooperable to move the slips radially outward where serrated outer surfaces on the slips grip the casing. The wedging action of the inclined surfaces maintains the grip of the slips with respect to a casing.

With a slip operated anchor device there are a number of practical considerations which include, inter alia, the diameter of the expander vis-a-vis the bore through the expander, the angle of the inclined surfaces and the length of the inclined surfaces and the strength of the materials. As a general proposition, it is desirable to maximize the bore size through the expander. Thus, for a given internal diameter of pipe, the effective wall space (the space from the expander bore to the outer diameter of the slips) for the expander and slips is reduced and this, in turn, reduces the available length for inclined surfaces and the angle of inclination required to obtain substantial outward radial travel for the slips. This situation becomes even more pronounced when the well bore or casing has a restricted bore along its length. For example, a well bore can contain a 3½ inch I.D. bore adjacent to a lower 5 inch I.D. bore. In this instance, the anchor device must traverse through a 3½ inch bore and expand to a 5 inch bore. Heretofore we have not been aware of any practical mechanical slip anchor devices utilizing slips which can pass through a restricted bore and subsequently be moved radially a substantial distance for gripping engagement with a casing and which can be subsequently retracted and retrieved.

SUMMARY OF THE INVENTION

This invention is embodied in a tubing anchor device. The anchor device is adapted for coupling to the lower end of a tubing string or a well tool. The anchor device includes a longitudinally extending, tubular central supporting mandrel. At the lower end of the supporting mandrel is an elongated expander member which has lengthwise extending first and second adjacent and inclined expander surfaces. Above the expander member is a tubular arm support on the supporting mandrel. The arm support pivotally supports downwardly extending and elongated arm members which are circumferentially arranged about the central axis of the supporting mandrel. At the lower and inwardly facing end of each arm member are longitudinally extending first and second adjacent and inclined arm surfaces. The outwardly facing wall at the lower end of each arm member has a recess which receives an external gripping member. The first inclined arm surfaces and the first expander surface have a complementary angle of 45° with respect to the central axis of the supporting mandrel in a retracted condition. The second inclined arm surfaces and the second expander surface have a complementary angle of 5° with respect to the central axis of the supporting mandrel when the second surfaces are engaged in an extended condition.

By relative longitudinal movement between the arm members and the expander member, the first surfaces are brought into engagement and the 45° angle produces a substantial radial outward movement of the lower ends of the arm member while the upper ends of the arm members the pivot in the arm support. When the adjacent second surfaces next engage, the angle of inclination is steep so that the engaged inclined surfaces can move the wall engaging members into gripping engagement with the casing.

The anchor device is provided with an emergency release which is responsive to rotation of the central supporting mandrel to threadedly uncouple a coupling nut and to a shear pin release of the central supporting mandrel from the expander member.

DESCRIPTION OF THE INVENTION

Figure 1:
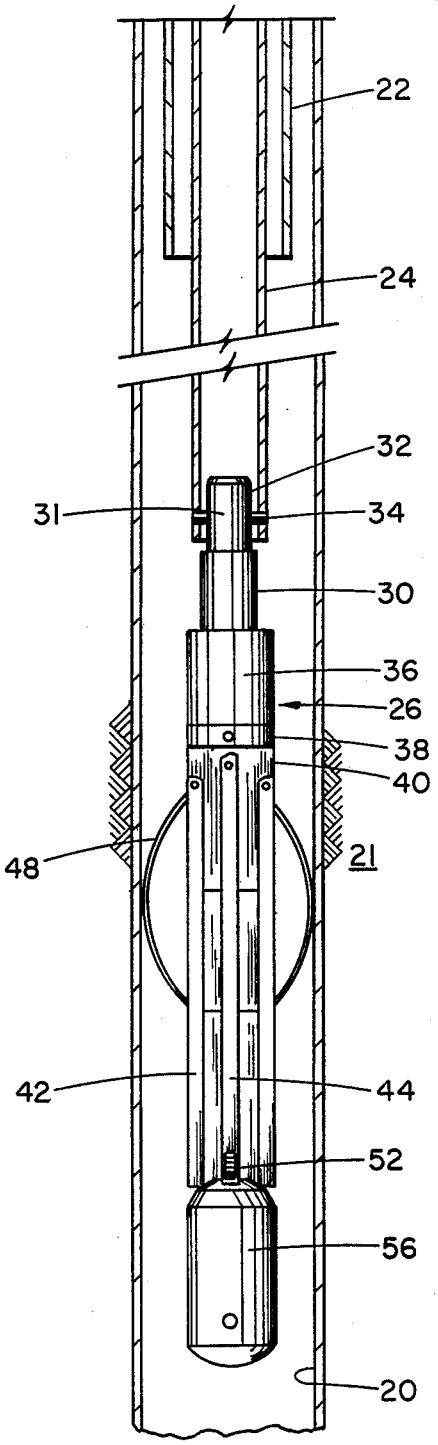
FIG. 1 is longitudinal view in partial cross section of a well tool embodying the present invention and disposed in a well bore.

Referring now to FIG. 1, a tubular metal casing 20 traverses earth formation 21. In the casing 21 is a tubular member 22 which has a bore diameter substantially less than the bore diameter of the casing 21. A smaller diameter tubing string 24 is shown with an attached tubing anchor device 26. The tubing anchor device 26 has a central supporting mandrel 30. The supporting mandrel 30 has an upper connection portion 31 with a reduced diameter recess 32 which is attachable by attaching means 34 to the lower end of the tubing string 24. On the supporting mandrel 30 is a tubular release housing member 36, a tubular coupling housing member and a tubular arm support member 40. The arm support member has two sets 42 and 44 of three arm members each. The sets 42, 44 of arm members are angularly disposed about the circumference of the arm support member and arranged so that an arm of set 42 is disposed between an adjacent pair of arms of set 44 and so that an arm of set 44 is disposed between an adjacent pair of arms of set 42.

One of the sets 44 of arms has overlaid spring members 48. The one end of a spring member 48 is attached to an arm **44*a* (see FIG. 2) while the opposite end of the spring member is free to slide along the outer surface of an arm. The spring members 48 are made of resilient spring material and bowed outwardly to frictionally engage the wall of a casing 20 in a well known manner. As may be appreciated the spring members 48 are compressed against the arm members of set 42 when passing through a restricted bore such as the pipe 22**.

At the lower end of each arm member and in the outer wall of each arm member is a recess 51 which receives a rectangularly shaped and elongated wall engaging member 52. A well engaging member 52 is pivotally mounted by a pivot pin in a recess 51 and has an outer serrated surface for engagement with a casing. The lower end of each arm member is disposed in a retracted condition adjacent to the central supporting mandrel and to an expander member 56. The expander member 56 is coupled to the central supporting mandrel 30.

Figure 2:
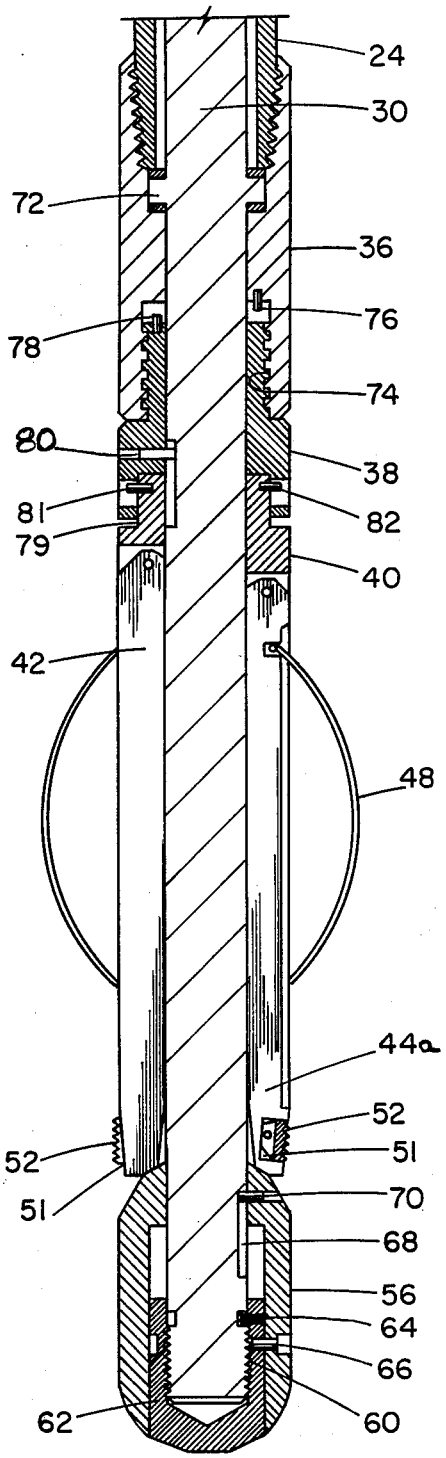
FIG. 2 is a longitudinal view in cross section of a well anchor device embodying the present invention.

Referring now to FIG. 2 and the remaining FIGS., the details of the structure will be described in respect to the drawing illustrations. The central supporting mandrel 30 is a cylindrically shaped member which has its lower end threadedly attached at 60 to an end cap member 62. A locking pin 64 in the cap member 62 engages an annular groove in the supporting member 30 rotatively couples the supporting mandrel 30 to the end cap member 62. The end cap member 62 is disposed in the hollow interior of the expander member 56 and coupled by a shear pin 66 to the expander member 56. The shear pin 66 is for an emergency release and when the shear pin 66 is released by shearing, relative movement of the supporting mandrel is permitted relative to the expander member 56. The supporting mandrel 30 has a vertical or longitudinally extending slot 68 which slidably receives a pin 70 in the expander member 56. The pin and slot prevent relative rotation and permit relative longitudinal movement. The pin 70 also limits upward movement of the expander member 56 relative to the supporting mandrel and limits downward movement of the expander member relative to the supporting mandrel.

At the upper end of FIG. 2 in the drawing, the supporting mandrel 30 has a flange 72 which is rotatively disposed between bearing plates in an annular recess in the housing member 36. The lower end of the housing member 36 has an internal left hand thread 74 which threadedly engage an external thread on coupling member 38. In the recess between the upper end of the coupling member 38 and the internal bore in the housing member 36, the housing member 36 has a downwardly extending pin 76 while the coupling 38 has an upwardly extending pin 78. The ends of the pins 76 and 78 are arranged and located so that from a position of engagement one relative rotation of the housing member 36 in a left-hand or counterclockwise direction will cause the ends of the pins to clear one another and permit the threaded uncoupling of the coupling member 38. Engagement of the pins 76, 78 on right-hand rotation prevents thread damage. Rotation of the tubing string 24 thus can move the coupling member 38 downwardly relative to the housing member 36. The coupling member 38 is co-rotatively coupled to the supporting mandrel 30 by a pin 80 in the coupling member which is slidably received in a longitudinal groove in the supporting mandrel 30.

Figure 3:
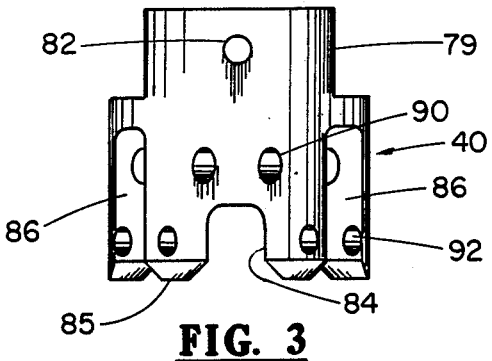
FIG. 3 is a side view of the arm support member.
Figure 4:
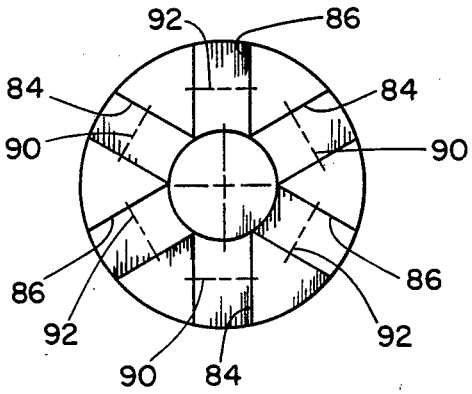
FIG. 4 is a bottom view of the arm support member.

As shown in FIGS. 2–4, the arm support member 40 is a tubular member which has at its upper end a reduced diameter section 79 which is arranged to be slidably received in a counter bore of the coupling member 38. The coupling member 38 has longitudinal slots 81 which cooperate which a pin 82 in the support member. The slots 81 and pins 82 provide a lost motion connection to enable release of the shear pin 66.

In the lower end of the arm support member 40 is a first set of longitudinal grooves 84 which extend upwardly from an end surface 85. A second set of longitudinal grooves 86 extends upwardly from the end surface 85 and are offset angularly from the grooves 84 by an angle of 60°. The grooves 86 are deeper or longer than the grooves 84. The vertical or longitudinal offset of the grooves 84, 86 accommodates different lengths of arm members in the sets 42 and 44 and permits location of the pivot connections 90, 92 (shown as axis in FIG. 4) in the support member 40. The length of the members is 12½ inches and 13½ inches for a 3½ inch diameter tool which permits the pivoting outward movement of the wall engaging ends of the arm members to a 5 inch internal diameter.

The arm members are substantially identical except that one set is longer than the other set and only one set carries the bow springs. A typical arm member **44*a* is illustrated in FIGS. 8–12 wherein the arm member has a cross section (FIG. 11, 12) which is a wall segment of tubular member with inner and outer curved wall surfaces 96, 98 and side wall surfaces 100, 102 that are angularly related. A wall surface 100, for example, if extended inwardly would intersect the longitudinal axis of the support member 30 and the curvature of the surfaces 96 would be complementary to the curvature of the supporting member 30. The arm member 44*a* has a lengthwise extending groove 104 which receives a spring member 48. (Only 3 of the arm members have spring members attached.) A threaded bore 106 is provided for attaching one end of a spring member to an arm member. One end 108 of the arm member is shaped to be received in a slot in the arm support member 40. The recess 51** is "T" shaped in cross section and a wall engaging member is pivotally mounted in a recess.

Figure 5:
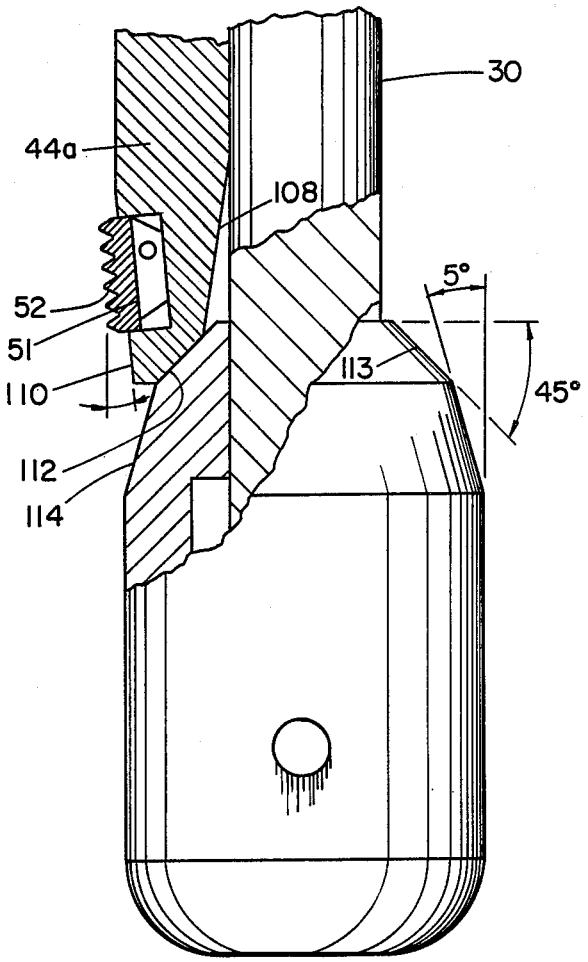
FIG. 5 is a partial view in partial cross section of the cooperating end of an arm member and the expander member.
Figure 9:
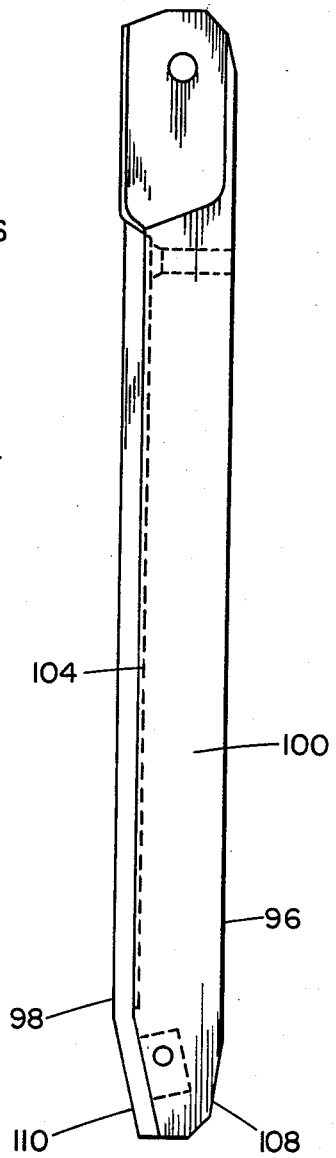
FIG. 9 is a side view of an arm member.
Figure 10:
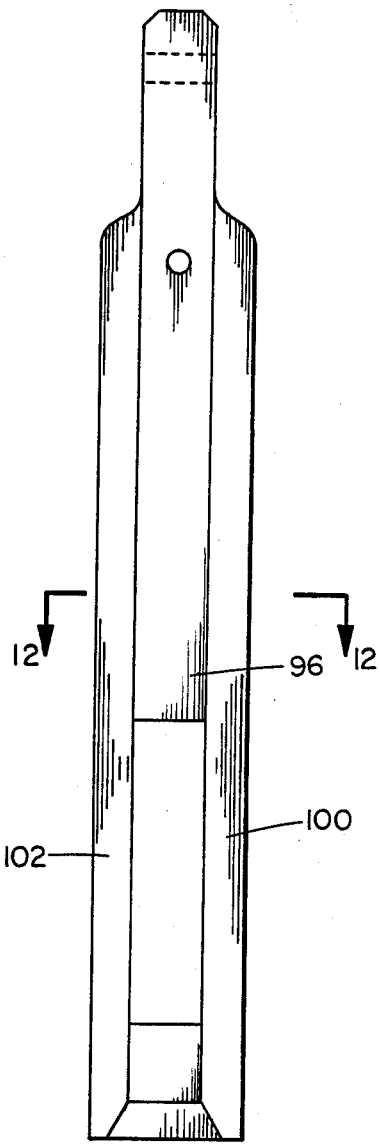
FIG. 10 is a bottom view of an arm member.
Figure 11:
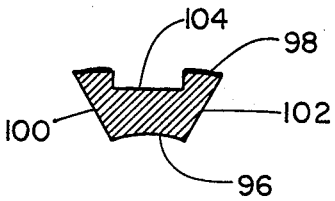
FIG. 11 is a view taken along line 11—11 of FIG. 8.
Figure 12:
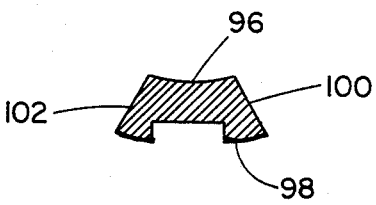
FIG. 12 is a view taken along line 12—12 of FIG. 10.

As shown in FIG. 9 and FIG. 5, the lower end of an arm has a tapered or inclined surface 108, 110 with respect to each of the lengthwise extending surfaces 96, 98. The angle of inclination of the surfaces 108, 110 is 5° relative to a lengthwise extending plane defined by the bottom surface of the groove 104.

Referring now to FIG. 5, on the arm member 44a is another second inclined surface 112 is adjacent to and adjoining the first surface 108 on the arm member. The surface 112 has an angle of inclination of 45° relative to the lengthwise extending plane defined by the bottom surface of the groove 104. In the collapsed position of an arm member as shown in FIG. 5 the surfaces 108, 110 are inclined at an angle of 5° relative to the longitudinal axis of the supporting member 30 while the surface 112 is at an angle of 45° relative to the longitudinal axis of the supporting member 30 and to a transverse axis. The expander member has a first annular and inclined surface 113 at an angle of 45° with respect to the longitudinal axis for the support member 30 and an adjacent and adjoining surface 114 which is at an angle of inclination of 5° relative to the central axis of the support member 30.

Figure 6:
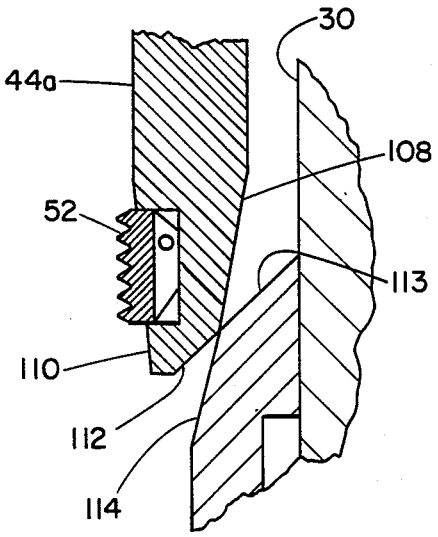
FIG. 6 is a view similar to FIG. 5 showing further relocation of the arm member relative to the expander member.
Figure 7:
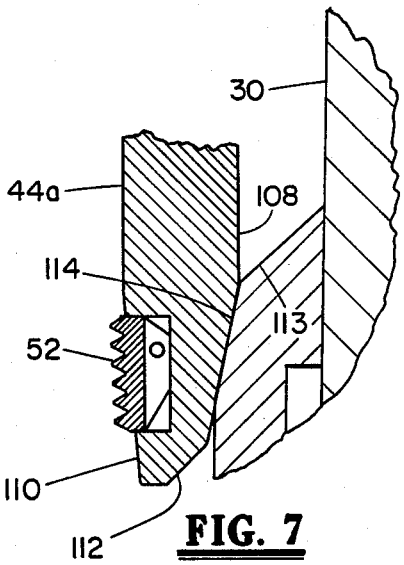
FIG. 7 is a view similar to FIG. 6 showing further relocation of the outer member relative to the expander member.
Figure 8:
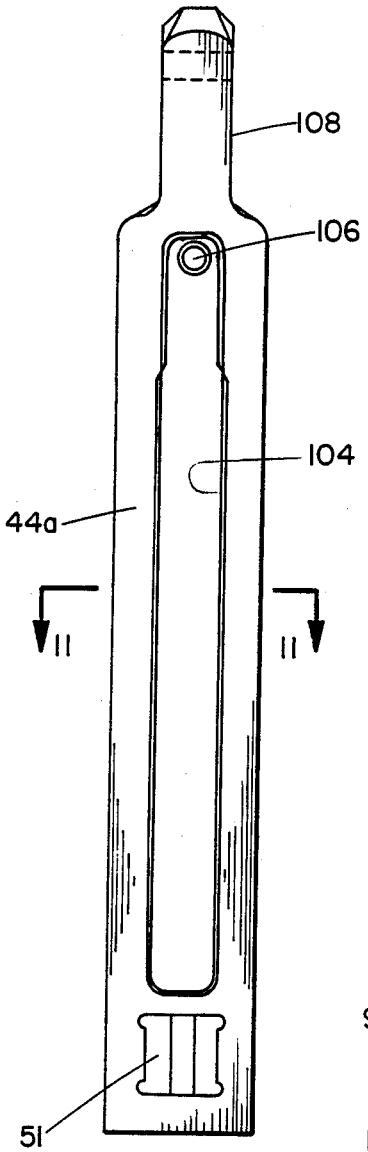
FIG. 8 is a top view of an arm member.

In the operation and functioning of the tool, it is attached to a string of pipe and lowered in a collapsed condition (shown in FIG. 2) to a location where anchoring is desired. The spring members 48 are in frictional engagement with the wall of a well casing. At the desired location, the tubing string is rotated in a left-hand or counterclockwise direction. The spring members 48 are attached to the arm members which are attached to the arm support member which is, in turn coupled to the member 38 so that rotation of the housing member 36 unscrews the threaded connection at 74 and moves the member 38 downwardly. As the member 38 moves downwardly the arm inclination surfaces 112 engage the expander inclination surface 113 (see FIG. 6) and the ends of the arm members carrying the wall engaging members 52 are cammed radially outwardly toward the casing wall. Continued downwardly movement of the member 38 moves the second surface 108 onto the surface 114 and downward relative movement occurs until the wall engaging member 52 engages the casing wall. The pivoted member 52 conforms to the wall surface and the outer surface 110 of a wall member is approximately parallel to the central axis of the supporting member. At the time the wall engaging member 52 grips the casing, the threaded connection between the member 36 and the member 38 remains connected and tension can be applied to the tubing string.

To recover the tool, right-hand or clockwise rotation pulls the member 38 upwardly which releases the wall engaging members and returns the assembly to a contracted position.

In the event the tool malfunctions in a set or anchored condition, then an upward pull sufficient to shear the pin 66 will release the expander member 56 relative to the wall engaging member 52.

It is also to be understood that the foregoing description of a preferred embodiment of the invention has been presented for purposes of illustration and explanations and is not intended to limit the invention to the precise form disclosed. It is to be appreciated therefore that changes may be made by those skilled in the art without departing from the spirit of the invention.

We claim:

1. Anchor means for retaining a pipe member in a fixed position in a well bore traversing earth formations where the anchor means is sized to pass through a smaller diameter well bore and to be anchored to a wall in a lower, larger diameter well bore comprising, an elongated anchor supporting member with an upper coupling end adapted for coupling to a pipe member and a lower terminal end, an expander member attached to said terminal end of said anchor supporting member, said expander member having adjacently located, lengthwise extending, first inclined expander surfaces and second inclined expander surfaces where said first and said second inclined expander surfaces respectively have different angles of inclination relative to a central longitudinal axis for said anchor supporting member, an annular arm support member slidably mounted relative to said anchor supporting member for longitudinal movement of said arm support member between a first contracted position and a second extended position, elongated arm members pivotally connected at one end to said arm support member so that the other end of said arm members can be moved radially outwardly from said anchor supporting member, said arm members being circumferentially disposed about said arm support member, said arm members having adjacently located, lengthwise extending, inner first and second inclined surfaces with different angles of inclination relative to the longitudinal axis for an arm member, wall engaging friction means coupled to said arm support member for frictionally engaging the wall of a well bore, wall engaging means on said arm members for gripping engagement with the wall of a well bore, and release means including a housing member rotatively coupled to said supporting member and threadedly coupled to said arm support member for selectively moving said arm support member between said first contracted position and said second extended position upon rotation of said housing member so that said first and second inclined arm surfaces on said slip members selectively engage said first and second inclined expander surfaces on said expander member and move said wall engaging means between a retracted condition and an extended condition radially outward and in gripping engagement with a wall of a well bore, said release means being operable upon rotation on an opposite direction for moving said wall engaging means from an extended condition to a retracted condition.

2. The apparatus as set forth in claim 1 and further including a shear pin release means disposed releasably coupling said expander member to said supporting member for emergency release from an extended position of the expander member.

3. Anchor means for retaining a pipe member in a fixed position in a well bore traversing earth formations where the anchor means is sized to pass through a smaller diameter well bore and to be anchored to a wall in a lower, larger diameter well bore comprising, an elongated anchor supporting member with an upper coupling end adapted for coupling to a pipe member and a lower terminal end, an expander member attached to said terminal end of said anchor supporting member, said expander member having adjacently located, lengthwise extending, first inclined expander surfaces and second inclined expander surfaces where said first and said second inclined expander surfaces respectively have different angles of inclination relative to a central longitudinal axis for said anchor supporting member, an annular arm support member slidably mounted relative to said anchor supporting member for longitudinal movement of said arm support member between a first contracted position and a second extended position, elongated arm members pivotally connected at one end to said arm support member so that the other end of said arm members can be moved radially outwardly from said anchor supporting member, said arm members being circumferentially disposed about said arm support member, said arm members having adjacently located, lengthwise extending, inner first and second inclined surfaces with different angles of inclination relative to the longitudinal axis for an arm member, wall engaging friction means coupled to said arm support member for frictionally engaging the wall of a wall bore, wall engaging means on said arm members for gripping engagement with the wall of a well bore, and release means coupling said supporting member and arm support member for selectively moving said arm support member between said first contracted position and said second extended position so that said first and second inclined surfaces on said arm members selectively engage said first and second inclined expander surfaces on said expander member and move said wall engaging means between a retracted condition and an extended condition radially outward and in gripping engagement with a wall of a well bore, said release means including a housing member rotatably supported on said supporting member and a threaded interconnection between said housing member and said arm support member.

4. The apparatus as set forth in claim 3 wherein said threaded connection is left-handed.

5. Anchor means for retaining a pipe member in a fixed position in a well bore traversing earth formations where the anchor means is sized to pass through a smaller diameter well bore and to be anchored to a wall in a lower, larger diameter well bore comprising, an elongated anchor supporting member with an upper coupling end adapted for coupling to a pipe member and a lower terminal end, an expander member attached to said terminal end of said anchor supporting member, said expander member having adjacently located, lengthwise extending, first inclined expander surfaces and second inclined expander surfaces where said first and said second inclined expander surfaces respectively have different angles of inclination relative to a central longitudinal axis for said anchor supporting member, an annular arm support member slidably mounted relative to said anchor supporting member for longitudinal movement of said arm support member between a first contracted position and a second extended position, elongated arm members pivotally connected at one end to said arm support member so that the other end of said arm members can be moved radially outwardly from said anchor supporting member, said arm members being circumferentially disposed about said arm support member, said arm members having adjacently located, lengthwise extending, inner first and second inclined surfaces with different angles of inclination relative to the longitudinal axis for an arm member, wall engaging friction means coupled to said arm support member for frictionally engaging the wall of a well bore, wall engaging means on said arm members for gripping engagement with the wall of a well bore, release means coupling said supporting member and arm support member for selectively moving said arm support member between said first contracted position and said second extended position so that said first and second inclined surfaces on said arm members selectively engage said first and second inclined expander surfaces on said expander member and move said wall engaging means between a retracted condition and an extended condition radially outward and in gripping engagement with a wall of a well bore, said arm support member having vertically slots respectively for each of said sets of arm members and the length of the arm members being arranged to dispose the ends of the arm members in circumferential alignment about said supporting member.

6. Anchor means for retaining a pipe member in a fixed position in a well bore traversing earth formations where the anchor means is sized to pass through a smaller diameter well bore and to be anchored to a wall in a lower, larger diameter well bore comprising, an elongated anchor supporting member with an upper coupling end adapted for coupling to a pipe member and a lower terminal end, said anchor supporting member having a central longitudinal axis, an expander member attached to said terminal end of said anchor supporting member, said expander member having adjacently located, lengthwise extending, first inclined expander surfaces at a first angle relative to said longitudinal axis to cause substantial radial outward movement relative to said anchor supporting member, and having second inclined expander surfaces at a second angle which is steep relative to said longitudinal axis to cause gripping engagement of a wall engaging means with the wall of a well bore, an annular arm support member slidably mounted relative to said anchor supporting member for longitudinal movement between a first contracted position and a second extended position, elongated arm members pivotally connected at one end to said arm support member so that the other end of said arm members can be moved radially outwardly from said anchor supporting member, said arm members being circumferentially disposed about said arm support member, said arm members having an adjacently located, lengthwise extending, inner first inclined surface and inner second inclined surface where said inner first inclined surface has a complementary angle to engage said first inclined expander surface and where said second inner second inclined surface has a complementary angle to engage said second inclined expander surface, wall engaging friction means coupled to said arm support member for frictionally engaging the wall of a well bore, wall engaging means on said arm members for gripping engagement with the wall of a well bore, and release means coupling said supporting member and arm support member for selectively moving said arm support member between said first contracted position and said second extended position so that said inner first and second inclined surfaces on said arm members selectively engage said first and second inclined expander surfaces on said expander member and move said wall engaging means between a retracted condition and an extended condition radially outward and into gripping engagement with a wall of a well bore.

7. The apparatus as set forth in claim 6 wherein said first and second angles are respectively a 45° angle of inclination and a 5° angle of inclination.

8. The apparatus as set forth in claim 6 wherein said wall engaging means includes an elongated member with a serrated outer surface and a pivotal connection to an arm member.

9. The apparatus as set forth in claim 6 wherein said friction means includes a bow spring member attached to at least three circumferentially spaced arm members.

10. The apparatus as set forth in claim 6 wherein there are two sets of three each arm members and said sets alternate arm members about the circumferences of said arm support member.

11. Anchor means for retaining a pipe member in a fixed position in a well bore traversing earth formations where the anchor means is sized to pass through a smaller diameter well bore and to be anchored to a wall in a lower, larger diameter well bore comprising, an elongated anchor supporting member with an upper coupling end adapted for coupling to a pipe member and a lower terminal end, said anchor supporting member having a central longitudinal axis, expander means on said terminal end of said anchor supporting member, said expander means including adjacently located, lengthwise extending, first inclined expander surfaces and second inclined expander surfaces where said first and said second inclined expander surfaces respectively have different angles of inclination relative to said central longitudinal axis for said anchor supporting member, elongated arm means mounted on said anchor supporting member, said arm means being circumferentially disposed about said anchor supporting member, said arm means having adjacently located, lengthwise extending, inner first and inner second inclined surfaces arranged with complementary angles of inclination relative to the first and second inclined expander surfaces where said arm means are contracted relative to said anchor supporting member in a first longitudinal position and radially extended in a second longitudinal position, said arm means having outer serrated surfaces arranged to be in gripping engagement with the wall of a well bore in said second longitudinal position where engagement of said inner second inclined surfaces with said second inclined expander surfaces produces the gripping force for gripping engagement and where engagement of said inner first inclined surfaces with said first inclined expander surfaces produces a substantial radially outward extension of said arm means from said anchor supporting member, and means for permitting movement of said arm means between said first and said second longitudinal positions for sequentially engaging said inner first inclined surfaces with said first inclined expander surfaces and said second inner inclined surfaces with said second inclined expanded surfaces.

* * * * *